US008830013B2

(12) United States Patent
Kunes

(10) Patent No.: US 8,830,013 B2
(45) Date of Patent: Sep. 9, 2014

(54) MULTI-BAND FILTER INCLUDING A PLURALITY OF PARALLEL FILTERS EACH CONFIGURED TO PROVIDE A PARTICULAR EFFECTIVE PATH LENGTH

(75) Inventor: Mark Anthony Kunes, Hitchin (GB)

(73) Assignee: Astrium Limited, Stevenage (GB)

( * ) Notice: Subject to any disclaimer, the term of this patent is extended or adjusted under 35 U.S.C. 154(b) by 277 days.

(21) Appl. No.: 12/824,807

(22) Filed: Jun. 28, 2010

(65) Prior Publication Data

US 2011/0254641 A1 Oct. 20, 2011

(30) Foreign Application Priority Data

Apr. 16, 2010 (EP) ..... 10275041

(51) Int. Cl.
*H01P 1/207* (2006.01)
*H01P 1/208* (2006.01)
*H01P 1/213* (2006.01)

(52) U.S. Cl.
CPC ..... *H01P 1/208* (2013.01); *H01P 1/2138* (2013.01)
USPC ..... 333/202; 333/212

(58) Field of Classification Search
CPC ..... H01P 1/207; H01P 1/208; H01P 1/213; H01P 1/2138
USPC ..... 333/126, 134, 135, 137, 202, 208, 212
See application file for complete search history.

(56) References Cited

U.S. PATENT DOCUMENTS

| | | | | |
|---|---|---|---|---|
| 2,626,990 | A * | 1/1953 | Pierce | 333/135 |
| 3,200,352 | A | 8/1965 | Lee | |
| 5,097,236 | A | 3/1992 | Wakino et al. | |
| 5,428,322 | A * | 6/1995 | Hendrick et al. | 333/126 |
| 6,118,978 | A | 9/2000 | Ihmels | |
| 6,201,949 | B1 | 3/2001 | Kich et al. | |
| 6,583,692 | B2 * | 6/2003 | Holme et al. | 333/212 |
| 7,983,637 | B2 * | 7/2011 | Kayano | 333/202 |
| 2003/0179052 | A1 * | 9/2003 | Sawdey et al. | 333/135 |
| 2004/0041635 | A1 | 3/2004 | Sano et al. | |
| 2007/0188263 | A1 | 8/2007 | Yu et al. | |

FOREIGN PATENT DOCUMENTS

| | | |
|---|---|---|
| EP | 0 396 123 | 11/1990 |
| EP | 1 394 893 | 3/2004 |
| EP | 1 819 010 | 8/2007 |
| WO | WO 2010/027310 | 3/2010 |

OTHER PUBLICATIONS

European Search Report dated Aug. 20, 2010, issued in the corresponding European Application No. 10275041.1-1248.

M.Kunes, "Microwave multiplexers for space applications", Electronics & communication Engineering Journal, Feb. 1998, pp. 29-35.

P. Gatenby et al., "The Evolution of Telecommunications Payloads and the Challenges for Microwave Technlogies", Microwave Technology and Techniques workshop, ESTEC, Noordwijk, Holland, Oct. 8-9, 2002, 9 pages.

* cited by examiner

*Primary Examiner* — Benny Lee
(74) *Attorney, Agent, or Firm* — Buchanan Ingersoll & Rooney PC

(57) ABSTRACT

A multi-band filter is disclosed which includes an input manifold; an output manifold; and a plurality of filters connected in parallel between the input manifold and output manifold. The filters have a first section proximal to the input manifold which is matched to the input manifold and a second section proximal to the output manifold which is matched to the output manifold.

14 Claims, 4 Drawing Sheets

MULTI-BAND FILTER INCLUDING A PLURALITY OF PARALLEL FILTERS EACH CONFIGURED TO PROVIDE A PARTICULAR EFFECTIVE PATH LENGTH

FIELD

The present invention relates to a multi-band filter, in particular to a multi-band filter for space-based applications. More particularly, the present invention relates to a multi-band filter including a plurality of bandpass filters connected in parallel between an input manifold and an output manifold.

BACKGROUND

Communications satellites are commonly required to receive, process, and transmit signals across multiple communications channels. For this purpose, such satellites are typically provided with an output multiplexer (OMUX), an example of which will be briefly described with reference to FIG. 1.

The output multiplexer 100 is of a type commonly referred to as a manifold multiplexer, comprising a plurality of bandpass filters 101, 102, 103, 104 disposed at varying lengths along a manifold 105 having an input 107. Each filter 101, 102, 103, 104 attenuates any frequencies within an input signal a, b, c, d which fall outside of the filter's passband, a center frequency of which can be tuned by manually adjusting a tuning screw 106. The filtered signals a', b', c', d' are combined within the manifold into a frequency-multiplexed output signal a'+b'+c'+d'. However, each filter has a separate input. The output multiplexer does not function as a multi-band filter.

SUMMARY OF THE INVENTION

The present invention provides, in a first aspect, a multi-band filter comprising: an input manifold; an output manifold; and a plurality of filters connected in parallel between the input manifold and output manifold; wherein the filters have a first section proximal to the input manifold which is matched to the input manifold and a second section proximal to the output manifold which is matched to the output manifold.

Thus, the multi-band filter can effectively filter a signal through a plurality of pass-bands.

Preferably, the first and second sections of the filter are symmetrical between the input manifold and output manifold.

Preferably, each of the filters comprise a plurality of cavities configured to filter an input signal; wherein the first section comprises one or more cavities proximal to the input manifold and matched to the input manifold, and the second section comprises one or more cavities proximal to the output manifold and matched to the output manifold.

The present invention provides, in a second aspect, a system comprising at least one amplifier, and at least one multi-band filter, which comprises: an input manifold; an output manifold; and a plurality of filters connected in parallel between the input manifold and output manifold; wherein the filters have a first section proximal to the input manifold which is matched to the input manifold, and a second section proximal to the output manifold which is matched to the output manifold, wherein the input manifold is configured to receive a signal from the amplifier.

BRIEF DESCRIPTION OF THE DRAWINGS

Embodiments of the present invention will now be described, by way of example only, with respect to the following drawings, in which.

DETAILED DESCRIPTION OF THE INVENTION

The present invention is a multi-band filter, having a plurality of pass-bands. The multi-band filter is configured for use in a satellite system, preferably using cavity waveguide filters and waveguide manifolds to achieve a high Q factor.

Figure 2:
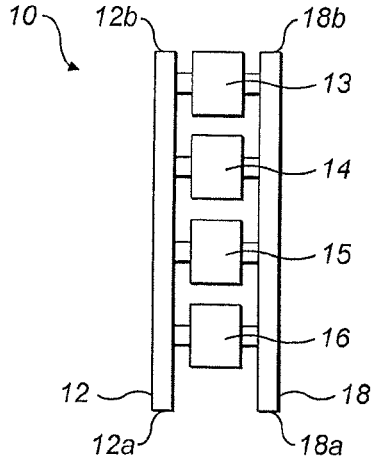
FIG. 2 is a schematic view of a first embodiment of a multi-band filter according to the present invention.

FIG. 2 shows a multi-band filter 10 according to the present invention. The multi-band filter 10 comprises an input manifold 12 and an output manifold 18. A plurality of bandpass filters 13, 14, 15, 16 are connected in parallel between the input manifold 12 and the output manifold 18.

The input manifold 12 is a linear waveguide, having a single input 12*a*. The manifold 12 has an end cap 12*b* terminating the waveguide. The waveguide input manifold 12 is dimensioned to guide microwave frequency (1 to 40 GHz) input signals. The input manifold 12 has a plurality of output ports allowing an input signal to pass into the bandpass filters 13, 14, 15, 16. The output ports are at a specific distance from the end cap 12*b*, according to the frequency to which that filter 13, 14, 15, 16 is tuned.

The output manifold 18 is a substantially linear waveguide, having a single output port 18*a*. The output manifold 18 has an end cap 18*b* terminating the waveguide. The waveguide output manifold 18 is dimensioned to guide microwave frequency (1 to 40 GHz) input signals. The output manifold 18 has a plurality input ports for receiving signals from the bandpass filters 13, 14, 15, 16. The input ports are at a specific distance from the end cap 18*b*, according to the frequency to which that filter 13, 14, 15, 16 is tuned.

The input manifold 12 and output manifold 18 preferably extend parallel to each other in the same plane, and are substantially identical with similar configurations and geometries. The configuration of the input manifold 12 and output manifold 18 may be approximately symmetrical, about a centreline extending mid-way between the input manifold 12 and output manifold 18. Preferably, there is a minor difference in arrangement between the input manifold 12 and output manifold 18 which will be detailed below.

The multi-band filter 10 may comprise two, three, four or more bandpass filters 13, 14, 15, 16 in order to provide two, three, four or more passbands, respectively. The bandpass filters 13, 14, 15, 16 are preferably cylindrical cavity waveguide filters. The bandpass filters 13, 14, 15, 16 preferably pass a pre-determined range of frequencies in a symmetrical pass band. The pass bands of the bandpass filters 13, 14, 15, 16 are preferably distinct from each other.

Figure 3:
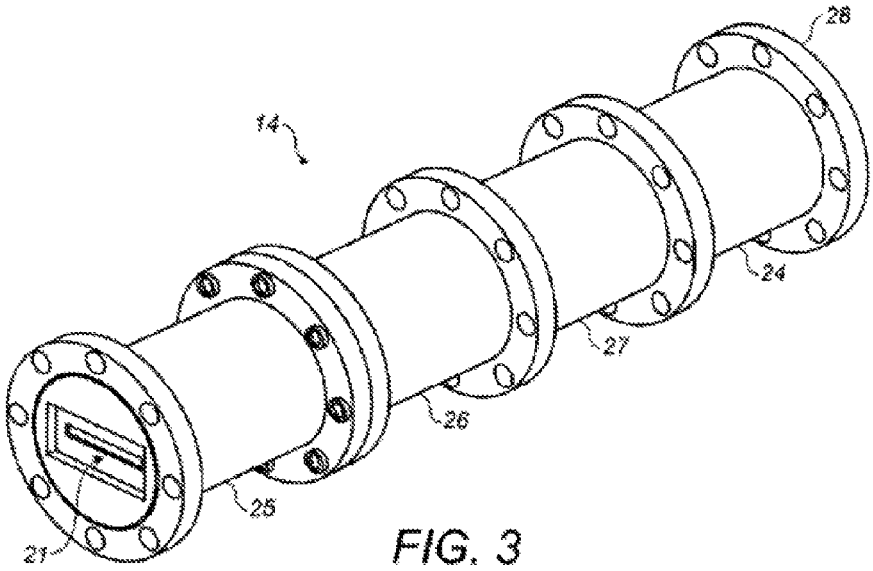
FIG. 3 is a perspective view of a filter forming part of the present invention.

FIG. 3 shows an example of a cavity waveguide filter forming the bandpass filter 14. The filter 14 is provided with an input 21 connected directly to the input manifold 12 (see FIG. 2) and an output 28 connected directly to the output manifold 18 (see FIG. 2). The filter 14 preferably comprises four resonant cavities 24, 25, 26, 27. The filters 13, 14, 15, 16 are preferably all filters of the same order, for example, second order filters. The cylindrical cavities 24, 25, 26, 27 within the filter 14 are connected by irises, such that a signal received via the input 21 passes from one cavity to the next towards the output 28. In the present example, a symmetric transfer function is achieved by cascading the four cavities 24, 25, 26, 27 linearly, the signal passing through each in turn.

In FIG. 3, the cavities 24, 25, 26, 27 are connected end-to-end in a straight line. The present invention is not restricted to filters of this design. Alternatively, the cavities may be connected by irises at 90° angles.

Figure 4:
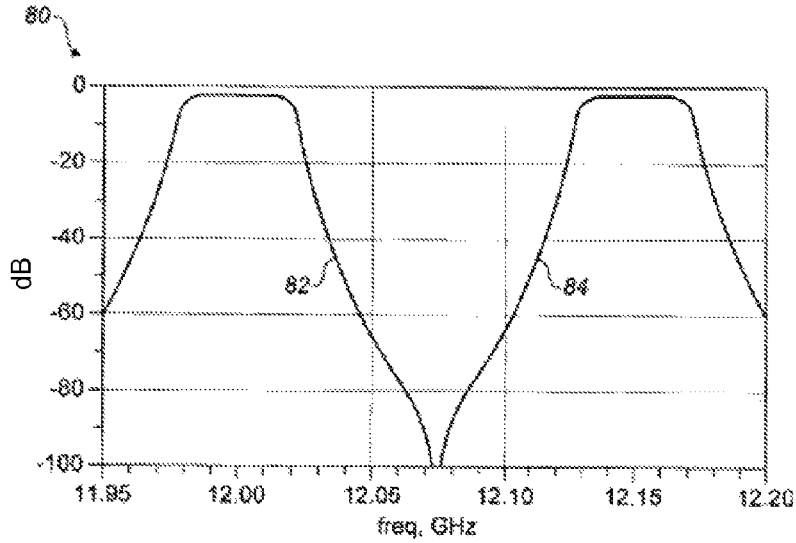
FIG. 4 is a graph showing an output from a multi-band filter according to the present invention.

FIG. 4 shows an example of an output 80 from a multi-band filter according to the present invention, having two bandpass filters operating in the range shown. The output 80 comprises two distinct passbands 82, 84 which are illustrated in relation to decibels (y-axis) versus frequency in GHz (x-axis). The filters have a high Q-factor, indicated by the sharp roll-off, which allows channels to be packed closely together and maintain good in-band performance to avoid distortion of the signal.

The bandpass filters must be matched to the input manifold 12 and output manifold 18. If the band-pass filters are not matched, losses due to reflections and interferences will arise. The filters are designed to be matched by having one or more cavities configured to compensate for the manifold, and provide the intended filter characteristic. In addition, interactions occur between the filters, which must be accommodated. A final matching and tuning of the cavities to a waveguide manifold is a complex process, involving fine adjustment of the resonant cavities to obtain the correct tuning. The filters 13, 14, 15, 16 of the present invention may be provided with tuning means, for example tuning screws, to allow optimization.

Figure 1:
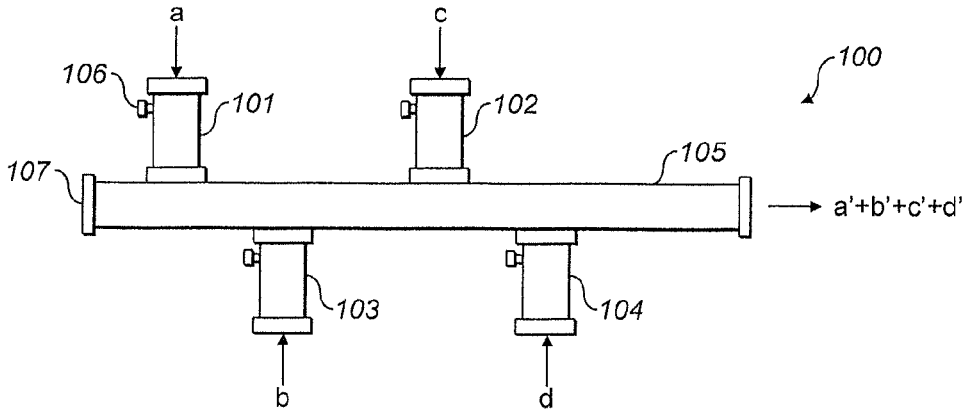
FIG. 1 PRIOR ART
FIG. 1 is a plan view of a manifold multiplexer as known in the art.

It is known to provide an output multiplexer (OMUX) having a plurality of filters and a single manifold, as shown in FIG. 1. The present invention takes advantage of the matching already achieved in the output multiplexer. The multi-band filter 10 of FIG. 2 uses a similar manifold to the manifold 105 of in FIG. 1 as the input manifold 12. However, merely attaching a waveguide manifold to the inputs of the filters 13, 14, 15, 16 will not provide a useful multi-band filter. The present invention recognizes that it is also important to match the filters 13, 14, 15, 16 to the input manifold 12, as well as to the output manifold 18.

A possible solution to match the filters 13, 14, 15, 16 is by joining together two identical known filters in series to create a single filter. Each of the two identical filters is known to be matched to the output manifold, and so will also be matched to the identical input manifold. However, it is well known that the connection of two filters in tandem is inefficient. The performance of a filter is not based only on the number of cavities. For example, two fourth order filters have a poorer performance than a single eighth order filter. This solution will therefore function, and may form part of the present invention.

Referring to FIG. 3, a bandpass filter forming part of the present invention can be considered as comprising two sections. A first section comprises one or more cavities 25, 26. The one or more cavities 25, 26 are proximal to the input manifold 12, i.e. one or more of the cavities 25, 26 are directly connected to the input manifold 12. One or more further cavities of the first section are connected to the cavity or cavities connected to the input manifold 12. The term "proximal" should be interpreted as referring to the section which is connected to the manifold, and may or may not be physically located closest to the manifold.

A second section comprises one or more cavities 24, 27. The one or more cavities 24, 27 are proximal to the output manifold 18, i.e. one or more of the cavities 24, 27 are directly connected to the output manifold 18. One or more further cavities of the second section are connected to the cavity or cavities connected to the output manifold 18.

The filters are preferably single, integrated, filters, directly connected between the input manifold 12 and output manifold 18. The first and second sections are preferably integrally formed as a single filter.

The first and second sections preferably have the same configuration. The second section preferably has the same number of cavities as the first section, which are dimensioned and connected identically. The input manifold 12 and output manifold 18 also have substantially the same configuration.

The filters are symmetrical between the input and output manifolds 12, 18. In particular, the arrangement of cavities 25, 26, 27, 24 are symmetrical between the input and output manifolds 12, 18. Preferably, cavities 25, 26, 27, 24 are symmetrical about a centreline between the input and output manifolds 12, 18. The cavities 25, 24 directly connected to the manifolds 12, 18, respectively, have the same dimensions and configuration as each other. Irises between the cavities and connecting the cavities to the manifolds are considered as part of the cavities, and preferably also have a symmetrical configuration between the input and output manifolds.

Cavities 26, 27, which are connected to the cavities 25, 24, respectively, have the same dimensions and configuration as each other. The dimensions and configuration of the cavities of the first section cavities may be different or the same as each other, and similarly, the dimensions and configuration of the cavities of the second section may be different or the same as each other. The symmetry of the filters means that the cavities proximal to the output manifold can be designed to match the output manifold. The cavities proximal to the input manifold can use the same, inverted, design as the cavities proximal to the output manifold.

The configuration of the at least one cavity 25, 26 of the first section is identical to the configuration of one or more cavities of a filter known to be matched to a known output multiplexer. In particular, the first section cavities 25, 26 have the same configuration as one or more of the cavities proximal to the manifold of the output multiplexer. A further part of the known filter, comprising one or more cavities distal from the output manifold, is not included in a filter according to the present invention.

Similarly, the configuration of the at least one cavity 27, 24 of the second section is identical to the configuration of one or more cavities of a filter known to be matched to an output multiplexer. In particular, the second section cavities 27, 24 have the same configuration as one or more of the cavities proximal to the manifold of the known output multiplexer. A further part of the known filter, comprising one or more cavities distal from the output manifold, is not included in a filter according to the present invention.

Referring to FIG. 3, the two cavities 25, 26 are configured as a part only of a filter comprising four cavities, which is matched to a manifold of the output multiplexer.

The cavities 25, 26 are configured as the two cavities proximal to the input manifold of the output multiplexer (as shown in FIG. 1, for example), in the same positions as known to a person skilled in the art. The cavities 27, 24 are also configured as the two cavities proximal to the output manifold of the output multiplexer (as shown in FIG. 1, for example), in the same positions (i.e. adjacent to the manifold and separated from the manifold) as known to a person skilled in the art.

The cavities of the known output multiplexer proximal to the manifold provide matching of the filter to manifold, and so the filter of the present invention will be matched to both the input manifold 12 and output manifold 18. The filters are therefore symmetrical between an input end and an output end.

The multi-band filter according to the present invention may form part of a satellite system, and in particular, part of a telecommunications satellite system.

In a first embodiment of a satellite system, the multi-band filter is located on an input side of the system. The multi-band filter is located before a low noise amplifier (LNA), such that the output port 18*a* of the output manifold 18 is connected to an input of the LNA. An LNA may be required to handle both a Broadcast Satellite Service (BSS) signal and a Fixed Service Satellite (FSS) signal which may be separated by a considerable frequency gap. The use of a single wide-band filter to cover the whole band may be inefficient. The multi-band filter of the present invention may be configured to pass both signal frequencies, and filter out an intermediate frequency range.

Figure 5:
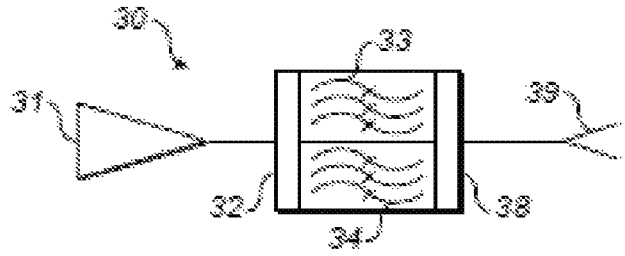
FIG. 5 is a second embodiment of a system including a second embodiment of a multi-band filter according to the present invention.
Figure 6:
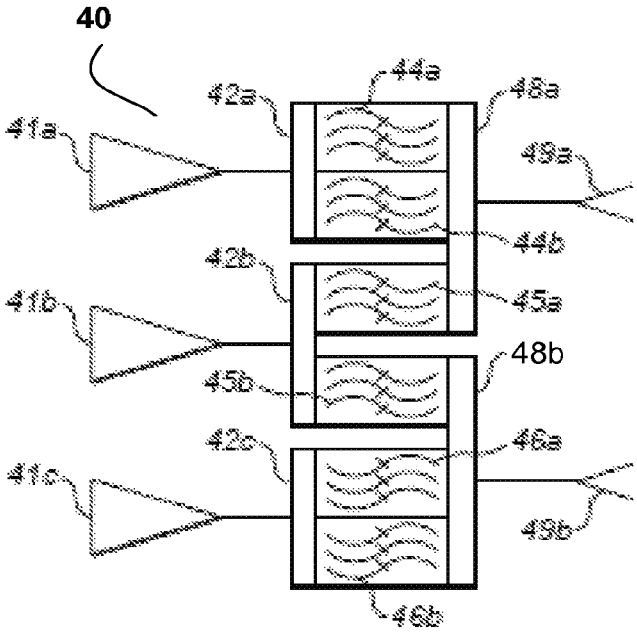
FIG. 6 is a third embodiment of a system including a third embodiment of a multi-band filter according to the present invention.
Figure 7:
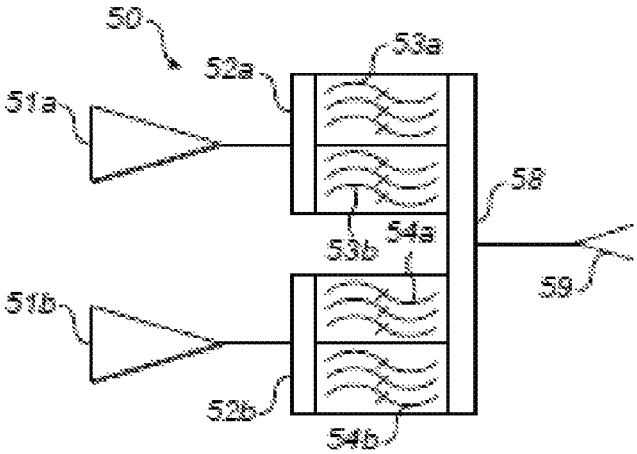
FIG. 7 is a fourth embodiment of a system including a fourth embodiment of a multi-band filter according to the present invention.

In a second to seventh embodiment of a satellite system, the multi-band filter is located on an output side of the system. FIGS. 5 to 7 show various arrangements, which are examples only. The multi-band filter is located after an amplifier and prior to a feed.

FIG. 5 shows a second embodiment of satellite system 30 including a multi-band filter having two pass bands. The multi-band filter comprises an input manifold 32, first bandpass filter 33, second bandpass filter 34, and an output manifold 38. The filters 33, 34 are configured as described above, i.e. having cavities which are symmetrical between the input and output manifold to which they are connected. The input manifold 32 receives an input signal from an amplifier 31. The amplifier 31 is preferably a high power amplifier, and in particular, a travelling wave tube amplifier (TWTA). The output manifold 38 outputs the filtered signal to a feed 39 for transmission.

FIG. 6 shows a third embodiment of a satellite system 40 including a plurality of multi-band filters. The multi-band filters comprise a total of six filters. The multi-band filters comprise three input manifolds 42*a*, 42*b*, 42*c*. The input manifolds 42*a*, 42*b*, 42*c* each receive an input signal from a corresponding amplifier 41*a*, 41*b*, 41*c*, respectively. The amplifiers 41*a*, 41*b*, 41*c* are preferably travelling wave tube amplifiers (TWTA).

A plurality of filters are connected to each input manifold 42*a*, 42*b*, 42*c*. In particular, two band-pass filters are connected to each input manifold 42*a*, 42*b*, 42*c*. Filters 44*a*, 44*b* are connected directly to input manifold 42*a*, filters 45*a*, 45*b* are connected directly to input manifold 42*b*, and filters 46*a*, 46*b* are connected directly to input manifold 42*c*.

A plurality of output manifolds 48*a*, 48*b* output the filtered signals to a plurality of feeds 49*a*, 49*b* for transmission. The number of output manifolds 48*a*, 48*b* may be the same, more or less than the number of input manifolds 42*a*, 42*b*, 42*c*. In FIG. 6, there are two output manifolds 48*a*, 48*b*, each directly connected to three filters. Output manifold 48*a* is connected to filters 44*a*, 44*b*, 45*a*, and output manifold 48*b* is connected to filters 45*b*, 46*a*, 46*b*.

The filters 44*a*, 44*b*, 45*a*, 45*b*, 46*a*, 46*b* are configured as described above, i.e. having cavities which are symmetrical between the input and output manifold to which they are connected.

The arrangement shown in FIG. 6 allows a single amplifier to carry two or more channels, with the channels routed to different downlink beams. This type of satellite system provides for flexibility in configuring which feed transmits each channel. A further satellite system may comprise a different configuration and number of filters, input and output manifolds. The system may comprise a plurality of input manifolds and/or a plurality of output manifolds, wherein a set of filters connected to at least one of the input manifolds is partially different to a set of filters connected to at least one of the output manifolds. Thus, one input manifold is connected via filters to a plurality of output manifolds, or, one output manifold is connected via filters to a plurality of input manifolds.

FIG. 7 shows a fourth embodiment of a satellite system 50 including a plurality of multi-band filters. The multi-band filters comprise a total of four filters. The multi-band filters comprise two input manifolds 52*a*, 52*b*. The input manifolds 52*a*, 52*b* each receive an input signal from a corresponding amplifier 51*a*, 51*b*, respectively. The amplifiers 51*a*, 51*b* are preferably travelling wave tube amplifiers (TWTA).

A plurality of filters are connected to each input manifold 52*a*, 52*b*. In particular, two band-pass filters are connected to each input manifold 52*a*, 52*b*. Filters 53*a*, 53*b* are connected directly to input manifold 52*a* and filters 54*a*, 54*b* are connected directly to input manifold 52*b*. The filters 53*a*, 53*b*, 54*a*, 54*b* are configured as described above, i.e. having cavities which are symmetrical between the input and output manifold to which they are connected.

A single output manifold 58 outputs the filtered signals to a single feed 59 for transmission. The number of output manifolds 58 is therefore less than the number of input manifolds 52*a*, 52*b*.

Figure 8:
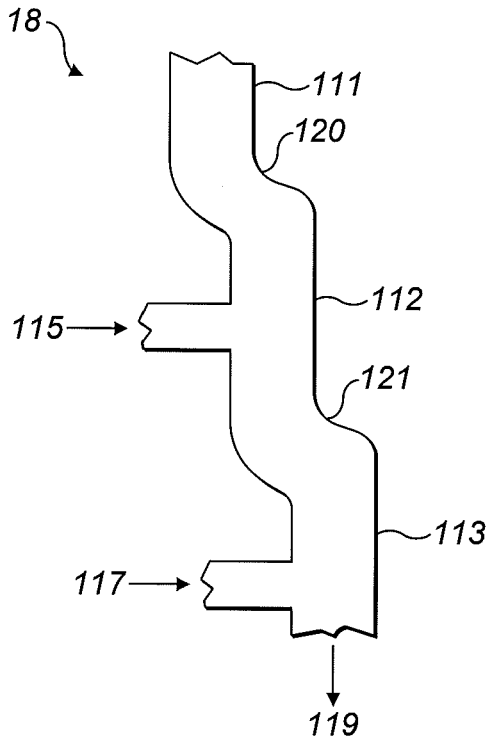
FIG. 8 is an enlarged plan view of a part of the multi-band filter according to the present invention.

FIG. 8 shows an enlarged view of part of the output manifold 18 of any embodiment. The filters require a particular effective path length between the input manifold 12 and output manifold 18 in order to function. The effective path length is dependent on the operating frequency of the filter, and so an effective path length between the input manifold and output manifold is unique for each filter.

Preferably, the input manifold and output manifold extend substantially parallel to each other. The effective path length for each filter is selected by providing at least one of the input manifold and output manifold with one or more stepped sections.

FIG. 8 shows the output manifold 18 having stepped sections 120, 121. The output manifold 18 is linear in sections 111, 112, 113 beyond the stepped sections 120, 121. A signal 115 from a first filter enters the output manifold 18 at stepped section 120, and a signal 117 from a second filter enters the output manifold 18 at stepped section 121 to form output signal 119. The input manifold and output manifold extend parallel to each other beyond the step(s). Preferably, only the output manifold is stepped. Alternatively, only the input manifold is stepped, or both the input and output manifolds are stepped.

Alternatively, the effective path length may be determined without having a stepped input manifold or output manifold. The input and output manifolds may be straight waveguides. The effective path length may be varied using one or more screws located in the output manifold and/or input manifold adjacent a said filter, or in the iris of a filter adjacent the output manifold and/or input manifold.

The filters of the multi-band filter have been described as band-pass filters, and preferably, none of the pass-bands of the filters overlap. Alternatively, one of the filters may be a high-pass filter and one of the filters may be a low-pass filter, and preferably, none of the pass-bands of the filters overlap. The bandpass filters of the multi-band filter preferably have a fixed, predetermined, pass-band.

One or more of the filters may comprise a third section comprising one or more cavities located between the first and second sections. Cavities of the third section may not be symmetrical between the input and output manifolds. The cavities of the first, second and third sections may be integrally formed, or may be formed in separate filter units.

The input and output manifolds have been described as waveguide manifolds. The input and/or output manifold may be a rectangular cross-section waveguide or a ridge-guide waveguide. Alternatively, the input and output manifolds may be any type of transmission line. For example, the input and/or output manifold may be formed from co-axial cable or fiber-optic cable. The selection of the appropriate type of transmission line may depend on the frequency of the signals being carried, and the power of the signals.

The bandpass filters of the present invention have been described as having four cavities. Alternatively, the bandpass filters may have fewer or more cavities. In particular, the filters may each comprise 2, 6 or 8 cavities. Analogously to the filters described above, the cavities proximal to the input manifold are configured as the equivalent cavities proximal to the manifold in an output multiplexer. In addition, the cavities proximal to the input manifold are symmetrical with the cavities proximal to the output manifold.

The first and second sections proximal to the input and output manifolds have been described as each comprising two cavities. Alternatively, the first and second sections may each comprise one or more cavities, for example, one or three cavities. Preferably, the first and second sections have the same number of cavities, which are arranged symmetrically.

The invention claimed is:

1. A multi-band filter comprising:

an input manifold;

an output manifold; and a plurality of filters each connected in parallel between the input manifold and the output manifold, wherein:

each of the plurality of filters has a first section proximal to the input manifold which is matched to the input manifold, and a second section proximal to the output manifold which is matched to the output manifold;

each filter is a single integrated filter directly connected between the input manifold and the output manifold;

each filter is configured to pass a distinct pass band and requires a particular effective path length between the input manifold and the output manifold of the multi-band filter, respectively; and at least one of the input manifold and the output manifold comprises one or more stepped sections configured to provide the respective particular effective path length through each corresponding filter.

2. The multi-band filter as claimed in claim 1, wherein the first and second sections of each filter are symmetrical between the input manifold and output manifold.

3. The multi-band filter as claimed in claim 1, wherein each filter comprises a plurality of cavities configured to filter an input signal;

wherein the first section of each filter comprises one or more of the plurality of cavities proximal to the input manifold and matched to the input manifold, and the second section of each filter comprises one or more of the plurality of cavities proximal to the output manifold and matched to the output manifold.

4. The multi-band filter as claimed in claim 1, wherein each filter comprises a plurality of cavities configured to filter an input signal;

wherein the first section of each filter comprises one or more of the plurality of cavities proximal to the input manifold and matched to the input manifold, and the second section of each filter comprises one or more of the plurality of cavities proximal to the output manifold and matched to the output manifold, and wherein the one or more cavities of the first section have a position and configuration which have a symmetry with the one or more cavities of the second section about a centerline between the input manifold and the output manifold.

5. The multi-band filter as claimed in claim 1, wherein each filter comprises four cavities, such that the first section of each filter respectively comprises two cavities of the four cavities and the second section of each filter respectively comprises the remaining two cavities of the four cavities.

6. The multi-band filter as claimed in claim 1, wherein the first section of each filter comprises one or more cavities proximal to the input manifold and matched to the input manifold, and the second section of each filter comprises one or more cavities proximal to the output manifold and matched to the output manifold, and wherein the input manifold and one or more of the plurality of cavities of the first section of each filter which is proximal to the input manifold is configured as a part only of an output multiplexer and the output manifold, and one or more of the plurality of cavities of the second section of each filter which is proximal to the output manifold is configured as a part only of the output multiplexer.

7. The multi-band filter as claimed in claim 6, wherein each filter comprises four cavities, such that the first section of each filter respectively comprises two cavities of the four cavities and the second section of each filter respectively comprises the remaining two cavities of the four cavities, and the first section and second section each comprise two cavities configured as part of an output multiplexer, the two cavities being the two cavities of the output multiplexer proximal to the output manifold.

8. The multi-band filter as claimed in claim 1, wherein the input manifold and the output manifold are waveguides.

9. The multi-band filter as claimed in claim 1, further comprising:

a plurality of input manifolds and a plurality of output manifolds, wherein a set of said plurality of filters connected to at least one of the plurality of input manifolds is partially different to a set of said plurality of filters connected to at least one of the plurality of output manifolds.

10. The multi-band filter as claimed in claim 1, wherein the particular effective path length through each filter between the input manifold and the output manifold is different.

11. The multi-band filter as claimed in claim 1, wherein each filter is a respective bandpass filter.

12. A system comprising:

at least one amplifier;

at least one input manifold;

at least one output manifold; and a plurality of filters connected to form at least one multi-band filter according to claim 1, wherein the at least one input manifold of the at least one multi-band filter is configured to receive a signal from the at least one amplifier.

13. The system as claimed in claim 12 wherein the at least one input manifold comprises a plurality of input manifolds and/or the at least one output manifold comprises a plurality of output manifolds, wherein a set of said plurality of filters connected to at least one of the input manifolds is partially different to a set of said plurality of filters connected to at least one of the output manifolds.

14. The system as claimed in claim 12, further comprising a feed configured to receive an output from the at least one output manifold of the at least one multi-band filter.

* * * * *